US007379058B2

(12) United States Patent
Toyozawa et al.

(10) Patent No.: US 7,379,058 B2
(45) Date of Patent: May 27, 2008

(54) DISK APPARATUS

(75) Inventors: Noboru Toyozawa, Kanagawa (JP); Yoshiharu Nakajima, Kanagawa (JP); Hirotoshi Koyama, Kanagawa (JP)

(73) Assignee: Sony Corporation (JP)

( * ) Notice: Subject to any disclaimer, the term of this patent is extended or adjusted under 35 U.S.C. 154(b) by 480 days.

(21) Appl. No.: 10/542,503

(22) PCT Filed: Dec. 25, 2003

(86) PCT No.: PCT/JP03/16787

§ 371 (c)(1),
(2), (4) Date: Jul. 15, 2005

(87) PCT Pub. No.: WO2004/066246

PCT Pub. Date: Aug. 5, 2004

(65) Prior Publication Data

US 2006/0152460 A1 Jul. 13, 2006

(30) Foreign Application Priority Data

Jan. 24, 2003 (JP) ..... P2003-015810

(51) Int. Cl.
*G09G 5/00* (2006.01)

(52) U.S. Cl. ..... 345/211; 345/204

(58) Field of Classification Search ..... 345/87–88, 345/90, 92, 99–100, 102, 204, 211, 214
See application file for complete search history.

(56) References Cited

U.S. PATENT DOCUMENTS 5,515,068 A 5/1996 Uragami et al.
6,411,273 B1 6/2002 Nakamura et al.
6,462,725 B1 10/2002 Orisaka
7,002,547 B2 * 2/2006 Yamada ..... 345/102
2001/0035862 A1 * 11/2001 Nakamura et al. ..... 345/204
2002/0005843 A1 1/2002 Kurumisawa et al.
2003/0011548 A1 1/2003 Nakajima

FOREIGN PATENT DOCUMENTS

EP 1 035 536 A2 9/2000

(Continued)

OTHER PUBLICATIONS

International Search Report mailed Feb. 3, 2004.

(Continued)

*Primary Examiner*—Richard A. Hjerpe
*Assistant Examiner*—Mansour M. Said
(74) *Attorney, Agent, or Firm*—Radner Fishman & Grauer PLLC; Ronald P. Kananen

(57) ABSTRACT

A display apparatus that can improve power savings in a waiting mode is disclosed. The display apparatus (0) is used as a display component of an electronic device capable of switching between a normal power consumption state and a low power consumption state and includes a panel in which a display area (2) and a peripheral circuit section for driving the display area are integrally formed on an insulating substrate (1). The circuit section switches between an operation mode and a waiting mode responsive to switching between the normal power consumption state and the low power consumption state of a main body of the electronic device. In the waiting mode, a standby control operation stops driving the display area 2 and inactivates the circuit section to suppress power consumption.

6 Claims, 12 Drawing Sheets

FOREIGN PATENT DOCUMENTS

| | | |
|---|---|---|
| JP | 04-371999 | 12/1992 |
| JP | 07-199148 | 8/1995 |
| JP | 07-271323 | 10/1995 |
| JP | 10-214063 | 8/1998 |
| JP | 2000-163023 | 6/2000 |
| JP | 2000-166220 | 6/2000 |
| JP | 2001-272957 | 10/2001 |
| JP | 2001-282164 | 10/2001 |
| JP | 2002-099261 | 4/2002 |
| JP | 2002-207457 | 7/2002 |
| WO | WO-98/00827 | 1/1998 |
| WO | WO-01/48731 | 7/2001 |

OTHER PUBLICATIONS

Japanese Office Action No. 2003-015810: Dated—Nov. 13, 2007.
Austrian Patent Office Search Report issued in SG Application No. 200524415-1 dated Nov. 9, 2007.

* cited by examiner

DISK APPARATUS

TECHNICAL FIELD

The present invention relates to a display apparatus that is used as a display component of an electronic device capable of switching between a normal power consumption state and a low power consumption state. More specifically, it relates to a power saving technique of a display apparatus that enters a waiting mode in a low power consumption state.

BACKGROUND ART

A flat-shaped panel such as an active matrix type liquid crystal panel is frequently used as a display part of an electronic device. The active matrix type liquid crystal panel is a system-on-chip display (system display) in which a display area and a peripheral circuit section that drives the display area are formed integrally on an insulating substrate.

A small-sized electronic device, such as a cellular phone terminal and a PDA (Personal Digital Assistance), that can be switched between a normal power consumption state and a low power consumption state has been developed. There is a technique that has been known in which a display apparatus (system display) performs a so-called partial mode display in response to the low power consumption state when the main body (main set) of the electronic device is switched to the low power consumption state. For example, a liquid crystal panel incorporated into a cellular telephone terminal performs a so-called "standby mode display" in the low power consumption state. More specifically, only the minimum necessary information is displayed (the partial mode display) for purposes of power savings. However, in this partial mode, the display apparatus is substantially in an operating state and, therefore, the power savings cannot be expected so much. To respond to the low power consumption state of the main set in another way, there is proposed a method in which the display apparatus performs a preparation process (an OFF sequence) for shutting off the power supply before turning off the power supply to the display apparatus. In applications requiring suppression of the power consumption of the display apparatus (system display), this power supply shut-off method is adopted. However, in this case, a large capacity switch is required to shut off the power supply from the main set to the system display. As a result, there is a disadvantage in that the number of parts and, thus, the size and cost of the main set will be increased.

In recent years, there has been developed a technique that switches between an operation mode and a waiting mode (standby mode) in response to the switching between the normal power consumption state and the low power consumption state of the main body of the electronic device, as described in Japanese Patent Laid-open No. Hei 07-271323. In the standby mode, while a power supply voltage is supplied from the main set, power consumption of the panel is suppressed by blocking the operation of the system display and inactivating the peripheral circuit section included in the system display. In this standby mode, while the power supply from the main set to the system display is kept active, active power consumption of the system display is suppressed. This eliminates the need for the large capacity switch for turning off the power supply and, therefore, is advantageous in terms of the size and cost of the main set. However, there is still a problem to be solved in that, in the conventional standby mode, there is not a sufficient means for suppressing the active power consumption of the display apparatus, and therefore, sufficient power savings cannot be achieved in the standby mode.

DISCLOSURE OF INVENTION

In view of the problems of the related art described above, it is an object of the present invention to improve power savings of a display apparatus in a waiting mode. In order to achieve the above object, there is provided a display apparatus that is used as a display component of an electronic device capable of switching between a normal power consumption state and a low power consumption state and that includes a panel in which a display area and a peripheral circuit section for driving the display area are integrally formed on an insulating substrate, wherein the circuit section can switch between an operation mode and a waiting mode in response to the switching between the normal power consumption state and the low power consumption state of a main body of the electronic device, and the circuit section includes standby control means that, in the operation mode, operates by receiving a power supply voltage from the main body of the electronic device and drives the display area to show a desired image and, in the waiting mode, while receiving the power supply voltage from the main body of the electronic device, stops driving the display area and inactivates the circuit section to suppress power consumption of the panel. The standby control means is characterized in that it executes a control sequence to shut off direct current components flowing through resistive elements at least included in the circuit section during the inactivation.

More specifically, the display area includes pixel electrodes arranged as a matrix, common electrodes opposing to the pixel electrodes, and an electrooptic material held between the pixel and common electrodes, the circuit section includes drivers for writing signal voltages to the pixel electrodes, a common driver for applying a common voltage to the common electrodes, and an offset circuit for adjusting a level of the common voltage relative to the signal voltage, and the standby control means executes a control sequence to shut off direct current components flowing through resistive elements included in the offset circuit during the inactivation. Further, the circuit section includes, in addition to the common driver for applying the common voltage to the common electrodes and the offset circuit for adjusting the level of the common voltage, a start circuit for charging the offset circuit so as to apply the common voltage quickly upon activation of the panel, and the standby control means executes a control sequence to shut off direct current components flowing through resistive elements included in the start circuit during the inactivation. Still further, the display area includes pixels arranged as a matrix, the circuit section includes drivers for writing analog voltages having gradations in accordance with image information sent from the main body of the electronic device to the pixels, and an analog voltage generator for supplying at a plurality of levels of the analog voltages already corresponding to the gradations to the driver, and the standby control means executes a control sequence to shut off direct current components flowing through series resistive elements for voltage splitting included in the analog voltage generator during the inactivation. Further, the standby control means executes a control sequence to block clocks supplied to at least the circuit section to suppress charge and discharge occurring in the circuit section during the inactivation. For example, the circuit section includes a DC/DC converter for converting a primary power supply voltage supplied from the main body of the electronic device to a secondary power supply voltage in accordance with specifications of the panel, and the standby control means executes a control sequence to block clocks supplied to the DC/DC converter to suppress charge and discharge occurring in the DC/DC converter during the inactivation. Preferably, the panel includes thin-film transistors that form the display area and the peripheral circuit section for driving the display area on the common insulating substrate in an identical process.

According to the present invention, the standby control means is disposed in a distributed manner in each block of the circuit section arranged around the system display. This standby control means executes specific control sequences in response to standby instructions from the main set so as to inactivate each block of the peripheral circuit section of the system display, thereby suppressing power consumption of the panel. During this inactivation, in particular, the standby control means executes the control sequence to shut off the direct current components flowing through the resistive elements included in each block of the peripheral circuit section so that the power consumption of the panel can be suppressed to an extreme. In addition, the standby control means blocks the clocks supplied to each block of the peripheral circuit section of the system display during the inactivation so as to suppress the charge and discharge occurring in the circuit section and, therefore, reduce transit and flow-through currents to an extreme. Thus, the standby control means executes the specific inactivation control sequence in response to the standby instructions from the main set so as to suppress the direct currents, transit currents and flow-through currents flowing through the peripheral circuit section of the system display sequentially in the total system.

BEST MODE FOR CARRYING OUT THE INVENTION

Figure 1:
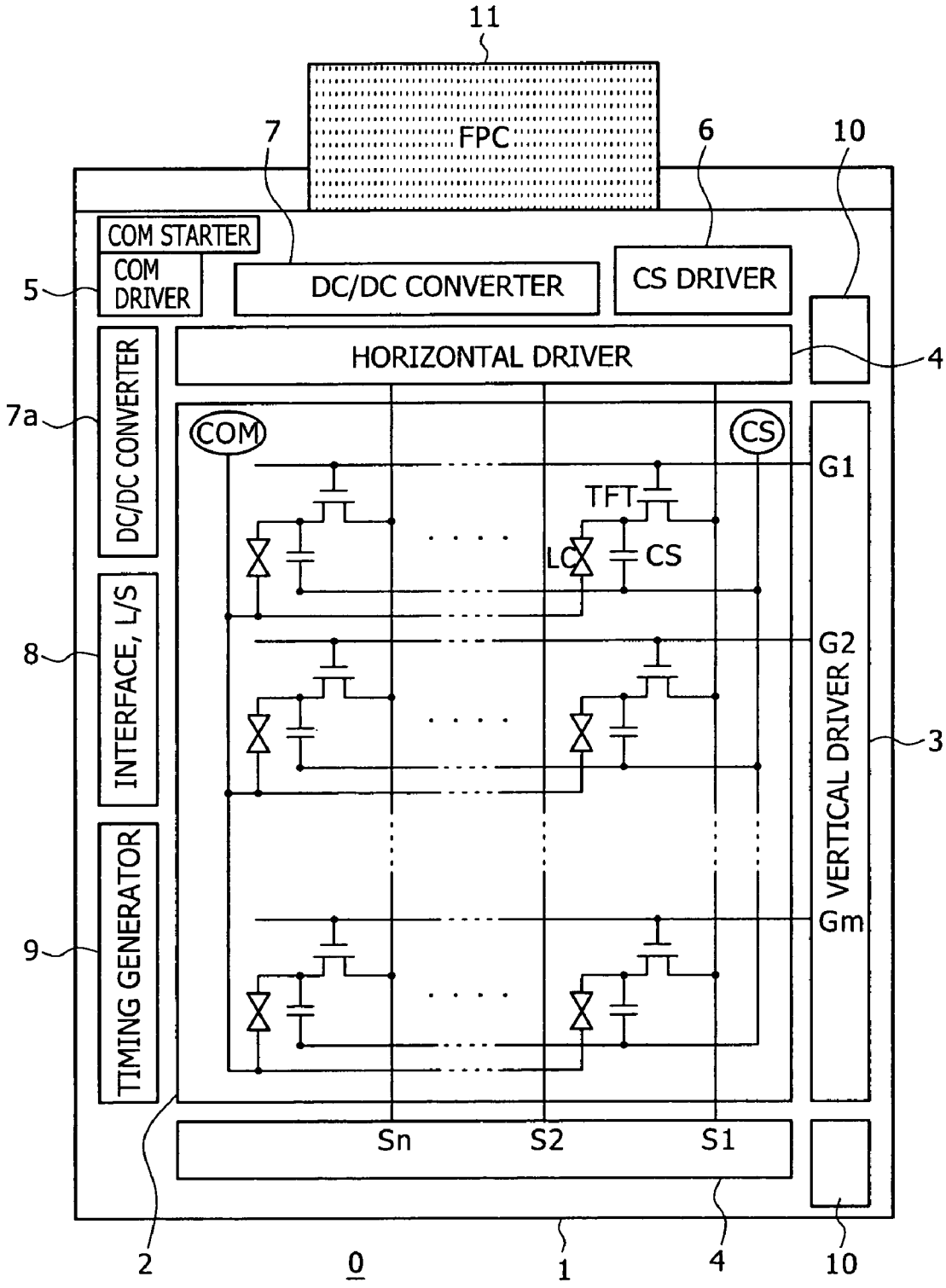
FIG. 1 is a block diagram showing an overall configuration of a display apparatus according to the present invention.

Hereinafter, embodiments of the present invention will be described in detail with reference to the drawings. FIG. 1 is a schematic block diagram showing an overall configuration of a display apparatus according to the present invention. As shown in the figure, this display apparatus 0 is formed in an integrated manner on an insulating substrate 1 made of glass and the like. A display area 2 is formed in the center of the insulating substrate 1 and a peripheral circuit section is formed integrally to encircle the display area 2. A connection terminal is formed on the top edge of the rectangular insulating substrate 1 to connect with a main body (main set) of an electronic device via a flexible printed cable (FPC) 11. The FPC 11 is a single-layer flat cable in which a plurality of wirings are arranged flatly.

The display area 2 is configured as a matrix in which rows of gate lines G1 to Gm and columns of signal lines S1 to Sn are crossed with each other. Pixels are formed at crossing points between the gate lines G and the signal lines S. In this embodiment, each pixel includes a liquid crystal element LC, a supplementary capacitor CS and a thin-film transistor TFT. The liquid crystal element LC includes a pixel electrode, a common electrode (COM) opposing to the pixel electrode, and a liquid crystal (electrooptic material) held between the pixel and common electrodes. The TFT has a gate electrode connected to the gate line G, a source electrode connected to the signal line S, and a drain electrode connected to the pixel electrode of the liquid crystal element LC. The supplementary capacitor CS is connected between the drain electrode of the TFT and the supplementary capacitance line. A selection pulse supplied from the gate line G brings the TFT into conduction to write a signal voltage supplied from the signal line S to the pixel electrode of the corresponding liquid crystal element LC. The supplementary capacitor CS keeps the signal voltage during one frame or one field.

The liquid crystal element LC is typically driven by alternating current. Thus, the polarity of the signal voltage written to the liquid crystal element LC via the signal line S is inverted periodically. According to this, a common voltage VCOM applied to the common electrode COM of the liquid crystal element LC also has to be inverted periodically. Here, it is to be noted that the liquid crystal element LC and the TFT for switching the LC are asymmetrical with regard to the polarity. Therefore, if the mean signal level at the pixel electrode is equal to that at the common electrode, the asymmetry with regard to the polarity may cause degradation of picture quality, such as image burn-in. To address this problem, the asymmetry with regard to the polarity may be canceled by offsetting the common voltage from the signal voltage by a predetermined voltage. Further, the supplementary capacitor CS has to be operated by alternating current in accordance with the liquid crystal element LC driven by alternating current. Therefore, a voltage whose polarity is inverted at a predetermined interval has to be applied to the supplementary capacitance line commonly connected to each supplementary capacitor CS.

The peripheral circuit section is formed in an integrated manner along the top, bottom, left and right sides encircling the display area 2 described above. In the case of this embodiment, this peripheral circuit section includes a vertical driver 3, horizontal drivers 4, a COM driver 5, a CS driver 6, a DC/DC converter 7, a DC/DC converter 7*a*, an interface 8 including a level shifter (L/S), a timing generator 9, an analog voltage generator 10 and the like. However, the present invention is not limited to this configuration and, according to the display apparatus (system display) 0 of the present invention, necessary circuits may be added as appropriate while unnecessary circuits may be omitted. For example, in some circumstances, a driver and the like may be incorporated to generate additional signal voltage levels for displaying absolute white and black.

The vertical driver 3 is connected to each of the gate lines G1 to Gm to supply selection pulses in a line-sequential manner. The horizontal drivers 4 form an upper and lower pair to connect with both ends of the signal lines S1 to Sn for supplying predetermined signal voltages from both sides simultaneously. Here, it is to be noted that the signal voltages correspond to display data (image information) sent from the main set via the FPC 11.

The common driver (COM driver) 5 applies the common voltage VCOM whose polarity is inverted periodically to the common electrode shared by each liquid crystal element LC. The COM driver 5 is equipped with an offset circuit and a start circuit (COM starter). The offset circuit adjusts an offset level of the common voltage generated by the common driver 5. The start circuit (COM starter) charges the offset circuit so as to apply the common voltage VCOM quickly upon activation of the panel. The CS driver 6 applies the voltage whose polarity is inverted periodically to the supplementary capacitance line shared by each supplementary capacitor CS.

The DC/DC converter 7 converts a primary power supply voltage supplied from the main body of the electronic device via the FPC 11 to a secondary power supply voltage in accordance with specifications of the panel (display apparatus 0). More specifically, the DC/DC converter 7 is used to convert the positive power supply voltage VDD. In contrast to this, the DC/DC converter 7*a* is used to convert the negative power supply voltage VSS.

The interface 8 including the L/S receives control signals such as clock signals, synchronization signals, image signals and the like supplied from the main set via the FPC 11. The level shifter L/S shifts the level of the control signals sent from the main set (external control signals) to generate the control signals in accordance with the operating specifications of the circuits in the display apparatus (internal control signals). In this description, when it is necessary to distinguish between the external and internal control signals, the external or internal control signals may be designated by the numeral (3) or (5), respectively, added after the symbols representing the type of the control signals. The timing generator 9 processes the clock signals and the synchronization signals sent from the interface 8 including the L/S to generate clock signals and the like necessary for timing control of the circuit section. The analog voltage generator 10 supplies analog voltages at a plurality of levels already corresponding to gradations to the horizontal drivers 4. The horizontal drivers 4 write the analog signal voltages having the gradations in accordance with the image information sent from the main body of the electronic device to the liquid crystal elements LC.

Figure 2A:
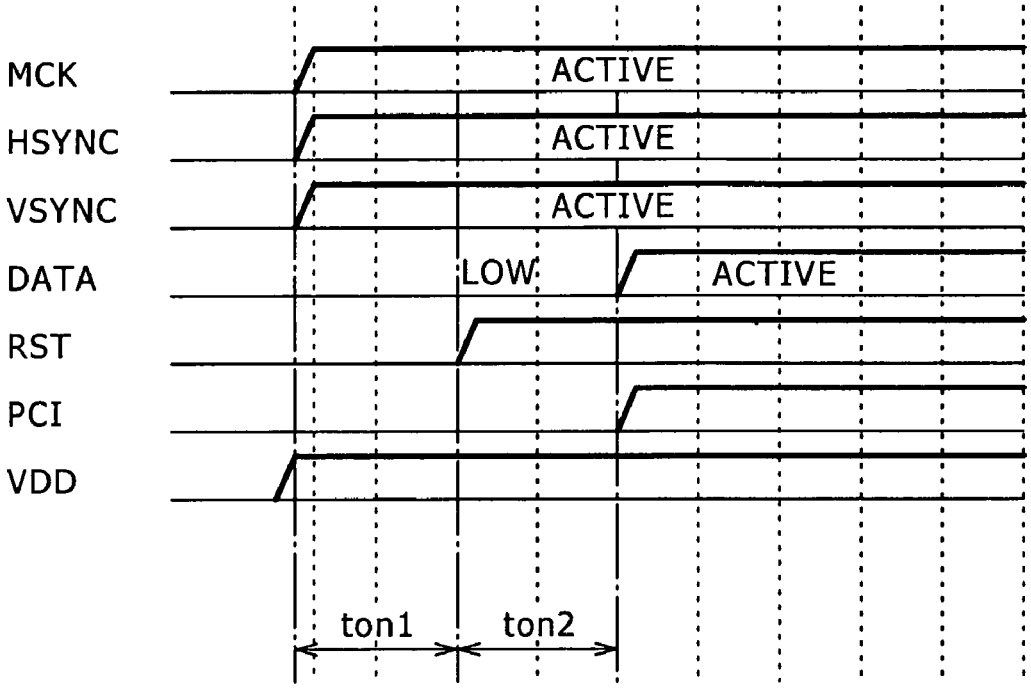
FIGS. 2A and 2B are timing charts showing ON and OFF sequences of a display apparatus.
Figure 2B:
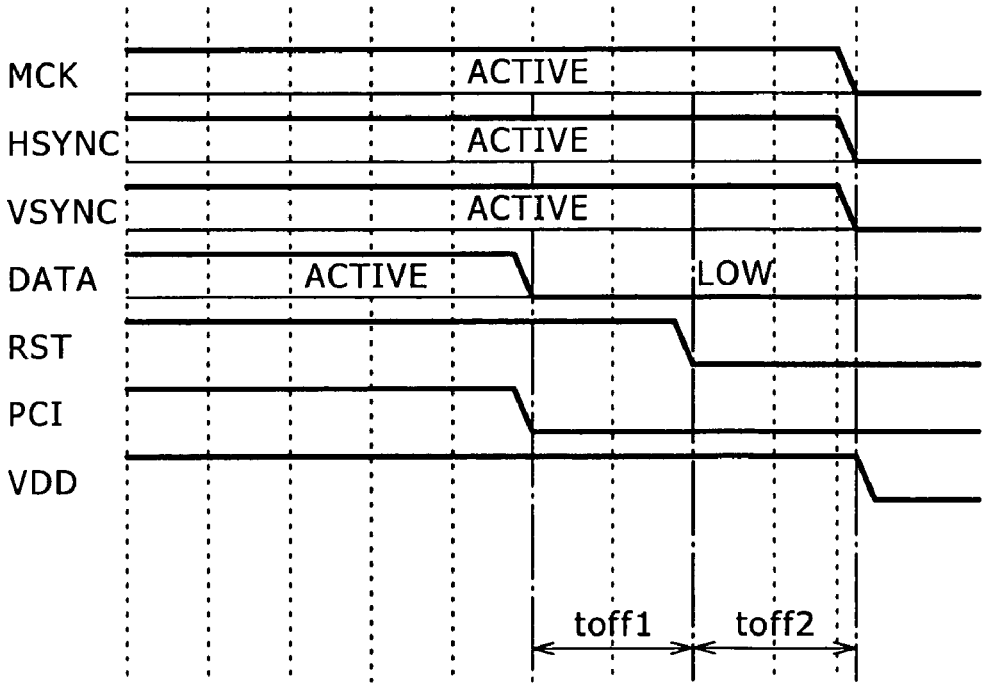

FIGS. 2A and 2B are timing charts showing control sequences by which the main set controls the display apparatus, wherein FIG. 2A shows an ON sequence and FIG. 2B shows an OFF sequence. Here, these figures show a typical case in which the sequence control is not executed in a waiting mode (standby mode). According to the predetermined sequences, the main set inputs a master clock MCK, a horizontal synchronizing signal HSYNC, a vertical synchronizing signal VSYNC, display data DATA, a reset signal RST, a display permission signal PCI, and a power supply voltage VDD to the display. In the ON sequence in which the main set starts up the display (FIG. 2A), the VDD rises first and, then, the MCK, HSYNC and VSYNC turn active. After the time tonl has elapsed, the reset signal RST is switched from low to high to initialize the circuit section of the display. Then, after the time ton2 has elapsed, the DATA is switched from low to high and the display permission signal PCI is switched from low to high. This allows the image to appear on the display area of the display.

In the OFF sequence in which the main set turns off the display (FIG. 2B), the DATA is switched from high to low first and the display permission signal PCI is switched from high to low. After the time toff1 has elapsed, the reset signal RST is switched from high to low to reset the internal state of the display circuits. After the time toff2 has elapsed, the supply of the MCK, HSYNC and VSYNC is shut off, and, finally, the VDD is turned off. This allows the VDD to be at the ground potential or the floating potential. However, in this case, the main set needs to have a large capacity switch to turn off the VDD and the number of components will be increased.

Figure 3A:
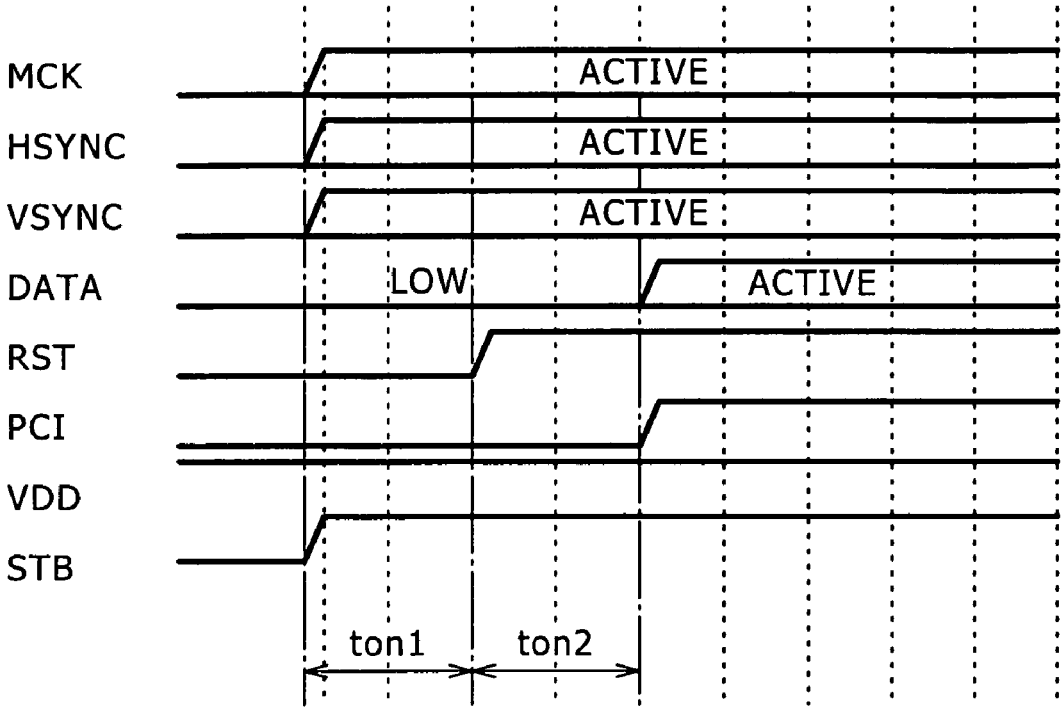
FIGS. 3A and 3B are timing charts showing ON and OFF sequences of a display apparatus equipped with a standby mode.
Figure 3B:
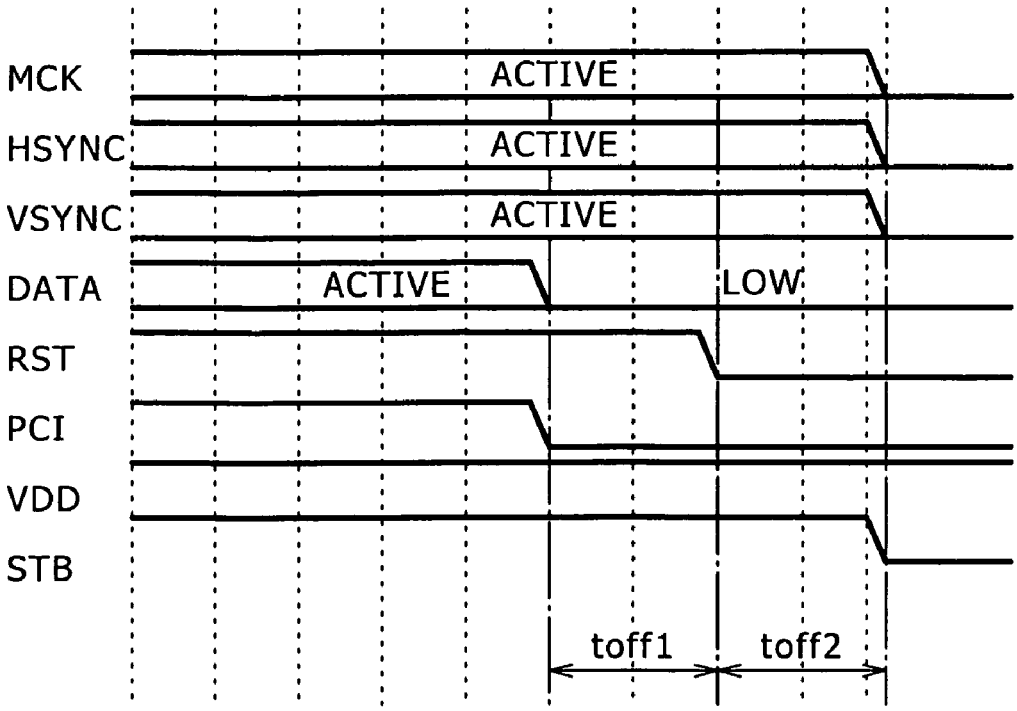

FIGS. 3A and 3B show timing charts showing ON and OFF sequences in which the waiting mode (standby mode) is adopted. For ease of understanding, corresponding parts to those in the typical ON and OFF sequences shown in FIGS. 2A and 2B are designated by like reference symbols. The main set can be switched between a normal power consumption state and a low power consumption state. According to this, the display needs to be switched between an operation mode and a waiting mode (standby mode) and, therefore, the main set inputs a standby signal STB to the display.

In the ON sequence (FIG. 3A), the standby signal STB is switched from low to high so that the display returns from the waiting mode to the operation mode. In response to the switching of the STB, the MCK, HSYNC and VSYNC turn active. However, the VDD is supplied continuously regardless of the STB. After the time ton1 has elapsed, the RST is switched from low to high to initialize the circuit state of the display. After the time ton2 has elapsed, the DATA turns active and the PCI is switched to high so that the image appears on the display area.

In the OFF sequence (FIG. 3B), first, the DATA and the PCI turn inactive. After toff1 has elapsed, the RST is switched from high to low to reset the internal circuits of the display. After toff2 has elapsed, the STB is switched from high to low and the MCK, HSYNC and VSYNC turn inactive. As the STB is switched from high to low, the display is switched from the operation mode to the waiting mode. On the other hand, even though the VDD is switched to the waiting mode, it is maintained at the power supply voltage continuously.

In such system that adopts the standby mode as described above, the need for a large-capacity switch is eliminated by making the driving circuit system of the display inactive according to the STB while keeping the VDD active. Here, though the signal STB used for controlling the standby mode may be input from the main set independently as shown in the figures, it may be generated by logically processing other external signals supplied from the main set inside the display. In the OFF sequence, the STB falls after the RST logically resets the internal circuits of the display. At this time, the master clock MCK, the synchronization signals HSYNC, VSYNC and the like supplied from the main set are switched from the active state to a fixed potential. Though these signals are fixed at low level (GND level) in the shown example, they may be fixed at VDD level in some circumstances.

The display apparatus, which is switched to the waiting mode in response to the fall of the standby signal STB, includes standby control means that stops driving the display area and inactivates the circuit section to suppress the power consumption of the panel, while the power supply voltage VDD is being supplied from the main body of the electronic device. The standby control means is disposed in a distributed manner in each block of the circuit section and executes a control sequence for inactivating each circuit block in response to the fall of the STB. Hereinafter, the control sequence for inactivating each circuit block will be described specifically.

Figure 4:
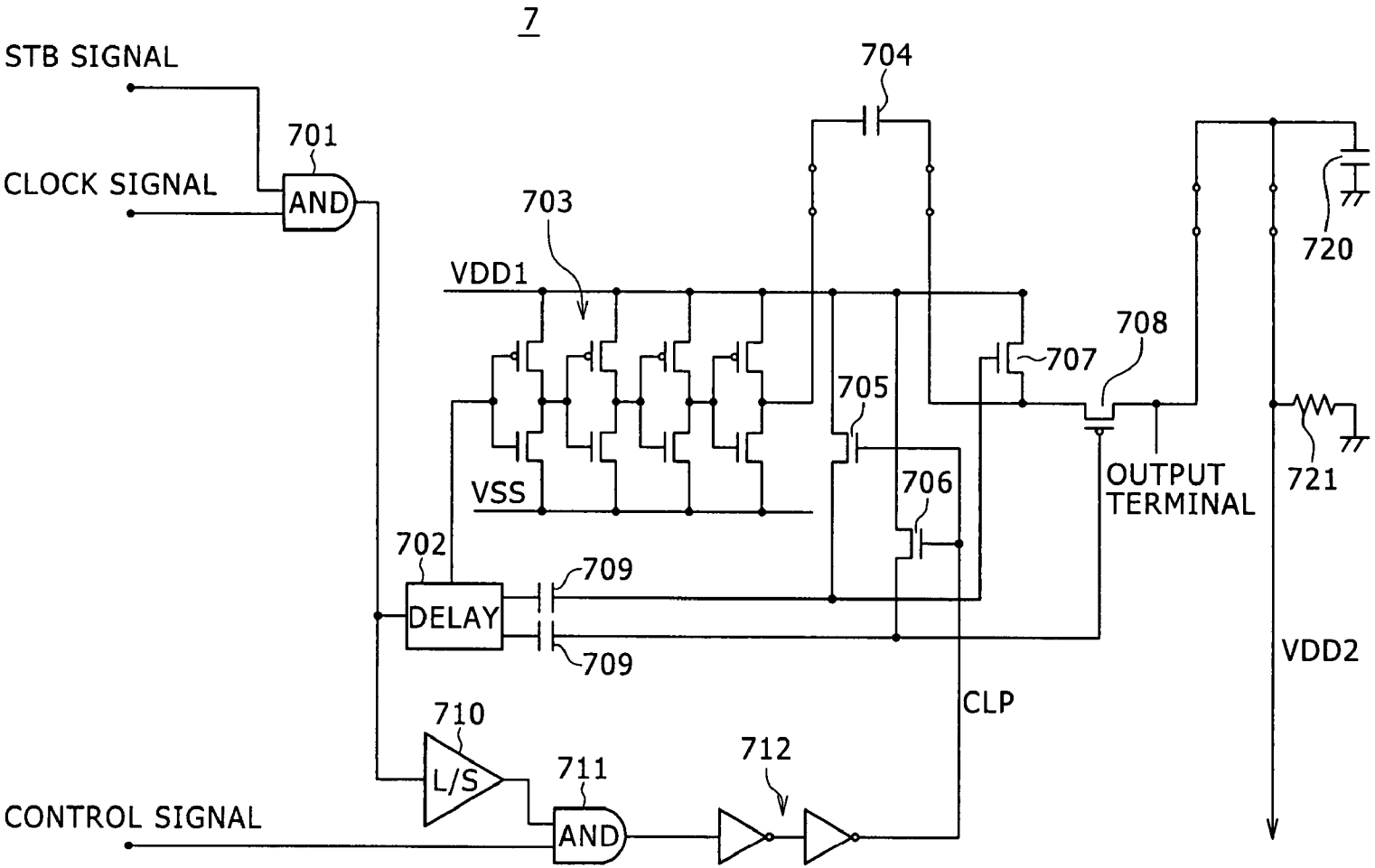
FIG. 4 is a circuit diagram showing an embodiment of a DC/DC converter included in a display apparatus.

FIG. 4 is a circuit diagram showing an example of a DC/DC converter 7 that adapts to the standby mode. As shown in the figure, the DC/DC converter 7 includes an AND element (AND) 701, a delay element (DELAY) 702, a multistage buffer 703, an external flying capacitor 704, clamping transistors 705 to 707, an output transistor 708, an internal capacitor 709, a level shifter (L/S) 710, an AND element 711, a buffer 712, an external bypass capacitor 720, a terminating resistor 721 and the like. The DC/DC converter 7 includes internal circuits built on the insulating substrate and external parts connected to the internal circuits via connection terminals. In the shown example, only the flying capacitor 704 and the bypass capacitor 720 are the external parts and all other circuit elements are built on the insulating substrate. The internal circuit section includes a TFT and the like, which are formed in a process identical to that for forming the thin-film transistors TFT on the display area.

The DC/DC converter 7 converts a primary power supply voltage VDD1 supplied from the main set to a secondary power supply voltage VDD2 in accordance with specifications of the panel. For this purpose, a pumping clock signal (pumping pulse) is supplied to the multistage buffer 703 via the AND element 701 and the delay element 702 for phase adjustment. The primary side of the flying capacitor 704 is pumped up to VDD1 via the multistage buffer 703. The secondary side of the flying capacitor 704 is connected to a clamping circuit including the TFT 705, 706, 707, which clamps the output voltage of the flying capacitor 704 up to VDD2. In this embodiment, it is clamped up to VDD2=2× VDD1. The output transistor 708 extracts the higher part of the rectangular wave clamped up to VDD2 and outputs the direct-current secondary power supply voltage VDD2. At this time, the external bypass capacitor (decoupling capacitor) 720 smoothes the secondary power supply voltage VDD2 by removing the ripple noise contained in the secondary power supply voltage VDD2. In this connection, the clock signal that has passed through the delay element 702 is applied to the drains of the clamping transistors 705, 706 via the internal capacitor 709 and, on the other hand, to the gate of the output transistor 708. Further, the clock signal that has passed through the AND element 701 is smoothed into a clamping pulse CLP by the level shifter 710, and the AND elements 711 and the buffer 712 are applied to the gates of the transistors 705, 706. Still further, a control signal is input via the AND element 711 to reset the DC/DC converter 7 as needed.

As described above, the DC/DC converter 7 basically includes the flying capacitor 704 that is pumped up to the primary power supply voltage VDD1 by the pumping pulse, the clamping circuit (the transistors 705 to 708) that clamps the pumped flying capacitor 704 to extract the secondary power supply voltage VDD2, and the bypass capacitor 720 that removes the noise contained in the secondary power supply voltage VDD2.

In order to implement the standby mode, the DC/DC converter 7 employs the AND element 701 as the standby control means, and it is configured to receive the STB signal. When the STB signal is switched from high to low to instruct to enter the standby mode, the AND element 701 is closed to shut off the input of the clock signal (pumping pulse). Power consumption is reduced by blocking the pumping pulse and, thus, the charge and discharge of the flying capacitor 704. In this connection, in the standby mode, the terminating resistor 721 fixes the output terminal of the DC/DC converter 7 to a specific potential, such as VDD1 or GND. This prevents the power supply line in the system display from being at the floating potential. Though the terminating resistor 721 is an internal element in the shown example, it may be mounted externally.

Figure 5:
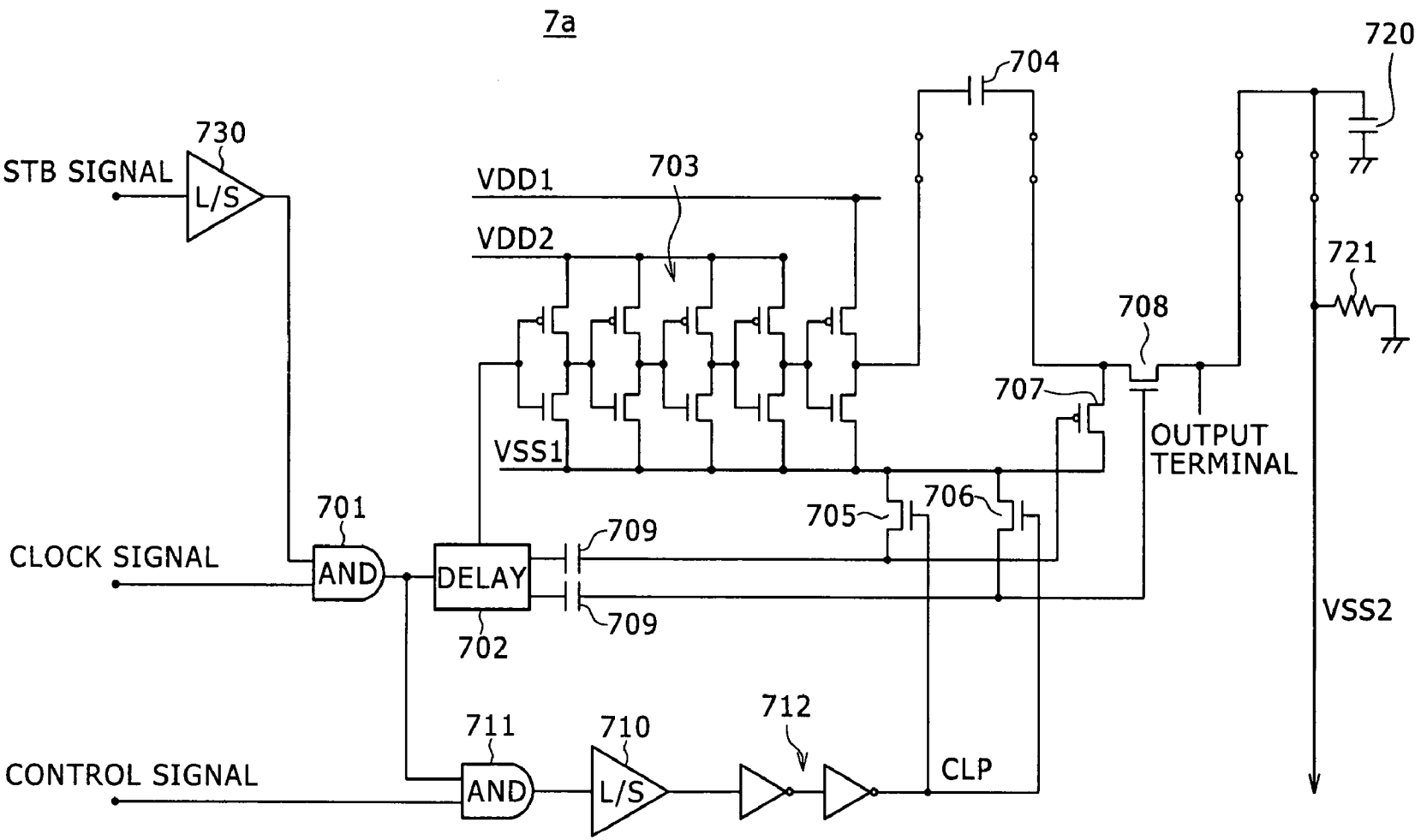
FIG. 5 is a circuit diagram showing an embodiment of a DC/DC converter included in a display apparatus.

FIG. 5 is a circuit diagram showing an embodiment of a DC/DC converter 7*a*. For ease of understanding, corresponding parts to those in the DC/DC converter 7 shown in FIG. 4 are designated by like reference numerals. While the DC/DC converter 7 in FIG. 4 converts the primary power supply voltage VDD1 at the positive side to the secondary power supply voltage VDD2 that is twice the VDD1, this DC/DC converter 7*a* converts the power supply voltage VSS1 at the negative side to the secondary power supply voltage VSS2 that is twice the VSS1 in absolute value.

The DC/DC converter 7*a* acts as a standby control means and inputs the STB signal to the AND element 701 via the level shifter 730. When the STB signal falls from high to low to instruct to enter the standby mode, the AND element 701 is closed to shut off the clock signal (pumping pulse) so that the charge and discharge of the flying capacitor 704 is blocked to reduce power consumption. In this connection, the terminating resistor 721 fixes the output terminal of the DC/DC converter 7*a* to a specific potential GND or VDD1.

Figure 6:
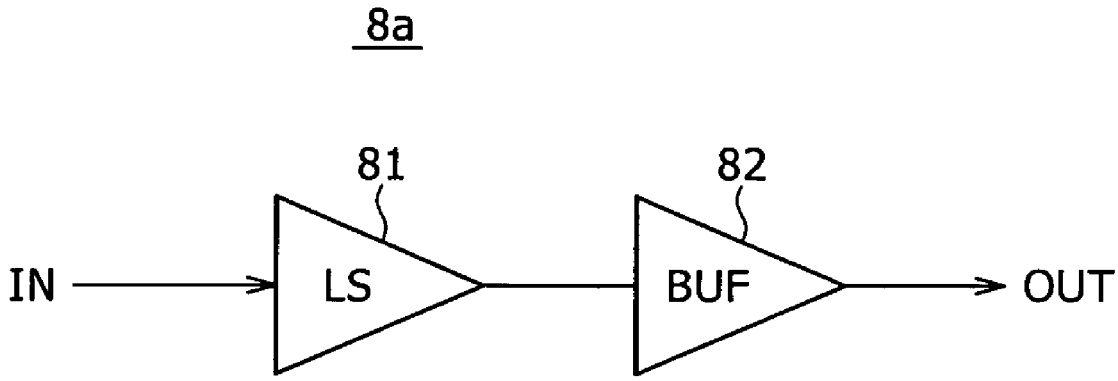
FIG. 6 is a block diagram showing an embodiment of a level shifter included in a display apparatus.

FIG. 6 is a block diagram showing an exemplary configuration of a level shifter 8*a* included in the input interface 8 of the display apparatus. As shown in the figure, the level shifter 8*a* includes a level shifting amplifier 81 and a buffer amplifier 82 that are connected in series with each other. In the operating state, an external input signal IN is level-shifted and, then, converted to an output signal OUT in accordance with the internal specifications of the display. In the waiting mode, the output terminal of the DC/DC converter is fixed to GND or VDD1 as described above. Therefore, the power supply line of each amplifier 81, 82 of the level shifter 8*a* is also fixed to GND or VDD1. Further, in the waiting mode, the input signal IN is fixed to GND or VDD1 level, and, therefore, the internal charge and discharge current does not flow.

Figure 7:
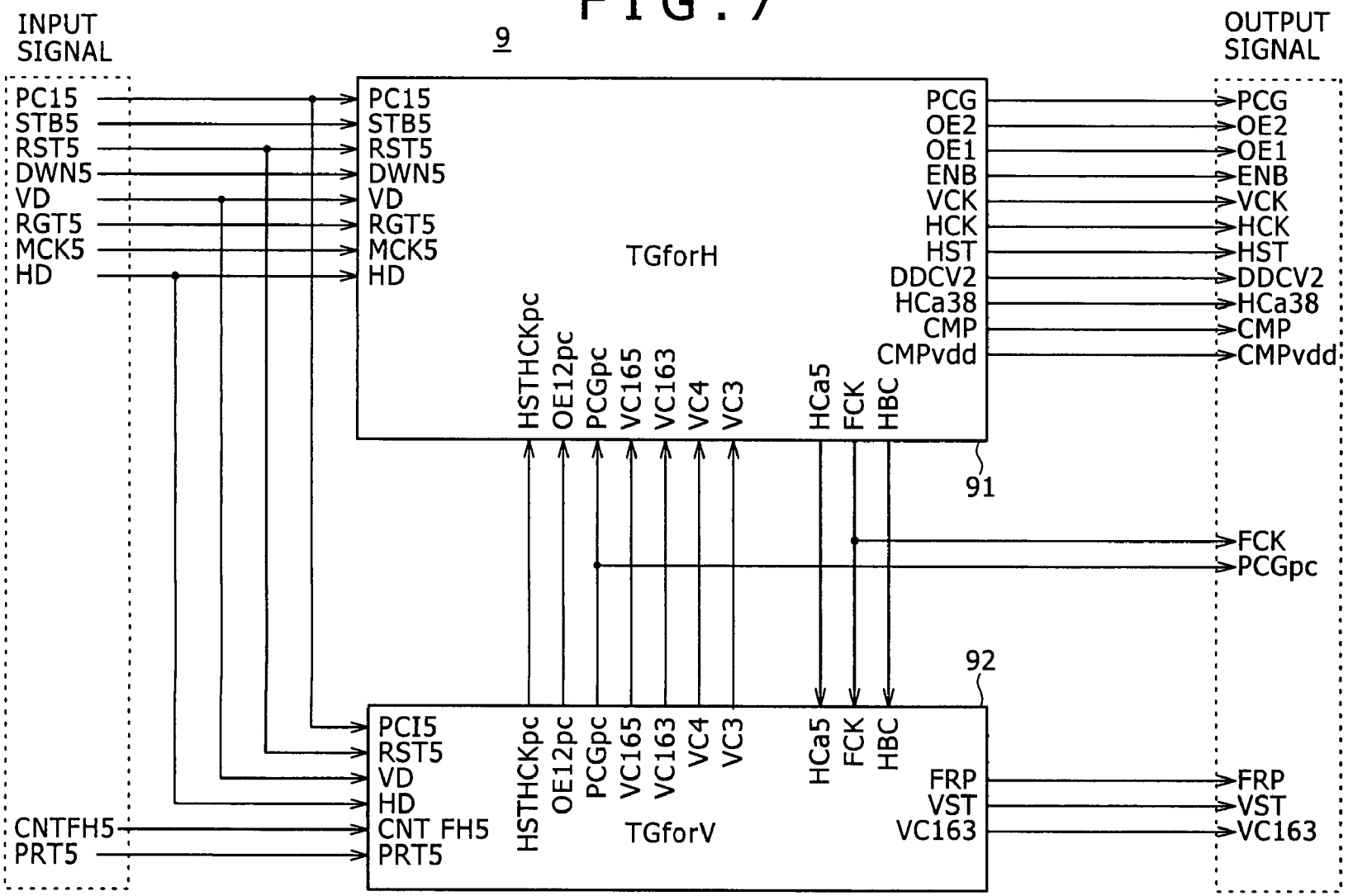
FIG. 7 is a block diagram showing an embodiment of a timing generator included in a display apparatus.

FIG. 7 is a block diagram showing an exemplary configuration of the timing generator 9. As shown in the figure, the timing generator 9 processes various input signals to generate output signals required for timing control in the system display. The input signals include PCI, STB, RST, VD, MCK, HD and the like. VD is an internal signal corresponding to the external VSYNC. Further, HD is an internal signal corresponding to the external HSYNC. The timing generator 9 includes a timing generator for horizontal driving (TG for H) 91 and a timing generator for vertical driving (TG for V) 92. The timing generator for horizontal driving 91 processes the input signals mentioned above to mainly generate output signals and the like required for timing control of the horizontal driver 4. Such output signals include a horizontal clock signal HCK and a horizontal start signal HST. Further, a vertical clock signal VCK is also output. On the other hand, the timing generator for vertical driving 92 mainly outputs the timing signals and the like required for operational control of the vertical driver 3. Such output signals include a vertical start pulse VST and a frame signal FRP.

In the standby mode, as described above, the output of the DC/DC converter is at GND or VDD1 level. Therefore, the power supply line of the timing generator 9 is also fixed to GND or VDD1 level. Further, the various input signals are also fixed to GND or VDD1 level. Therefore, the timing generator 9 does not operate and the charge and discharge current does not flow.

Figure 8:
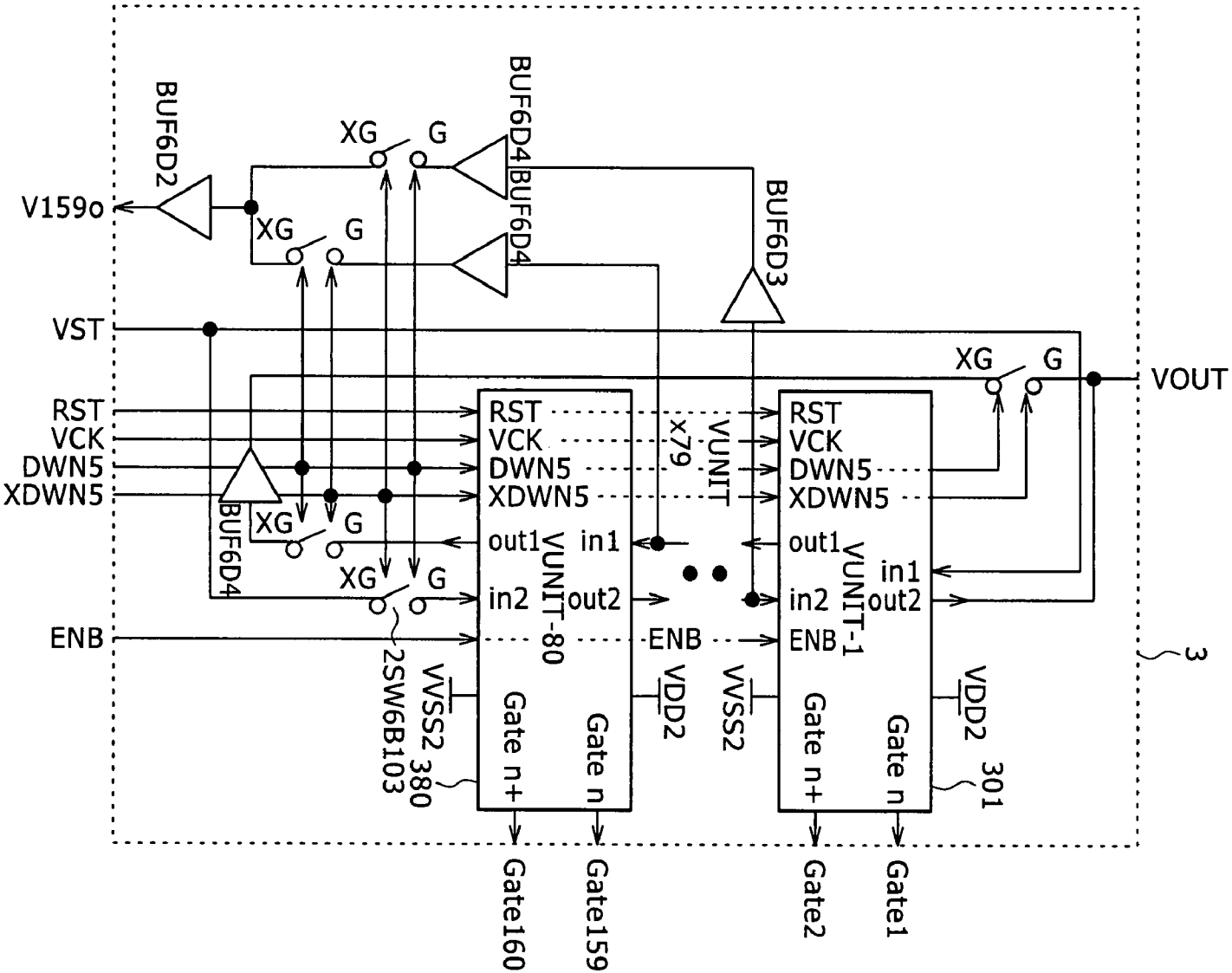
FIG. 8 is a circuit diagram showing an embodiment of a vertical driver included in a display apparatus.

FIG. 8 is a circuit diagram showing an embodiment of the vertical driver 3. As shown in the figure, the vertical driver 3 is configured as a shift register in which a plurality of units 301 to 380 are connected in a multistage manner. In this example, 80 units are connected in a multistage manner so that two gate lines per stage, i.e., 160 gate lines in total (Gate 1 to Gate 160) are driven sequentially. More specifically, the vertical driver 3 outputs the selection pulse to each gate line by transferring the vertical start pulse VST sequentially in synchronization with the vertical clock VCK.

In the waiting state, the timing generator does not operate. Therefore, the control signals input to the vertical driver 3 are fixed to GND or VDD1 level. Therefore, power consumption can be reduced because the vertical driver 3 does not operate and the charge and discharge current for the gate lines does not flow. Further, though not shown in the figure, the horizontal driver 4 also does not operate and, as a result, the charge and discharge current does not flow into the signal line and power consumption can be reduced.

Figure 9:
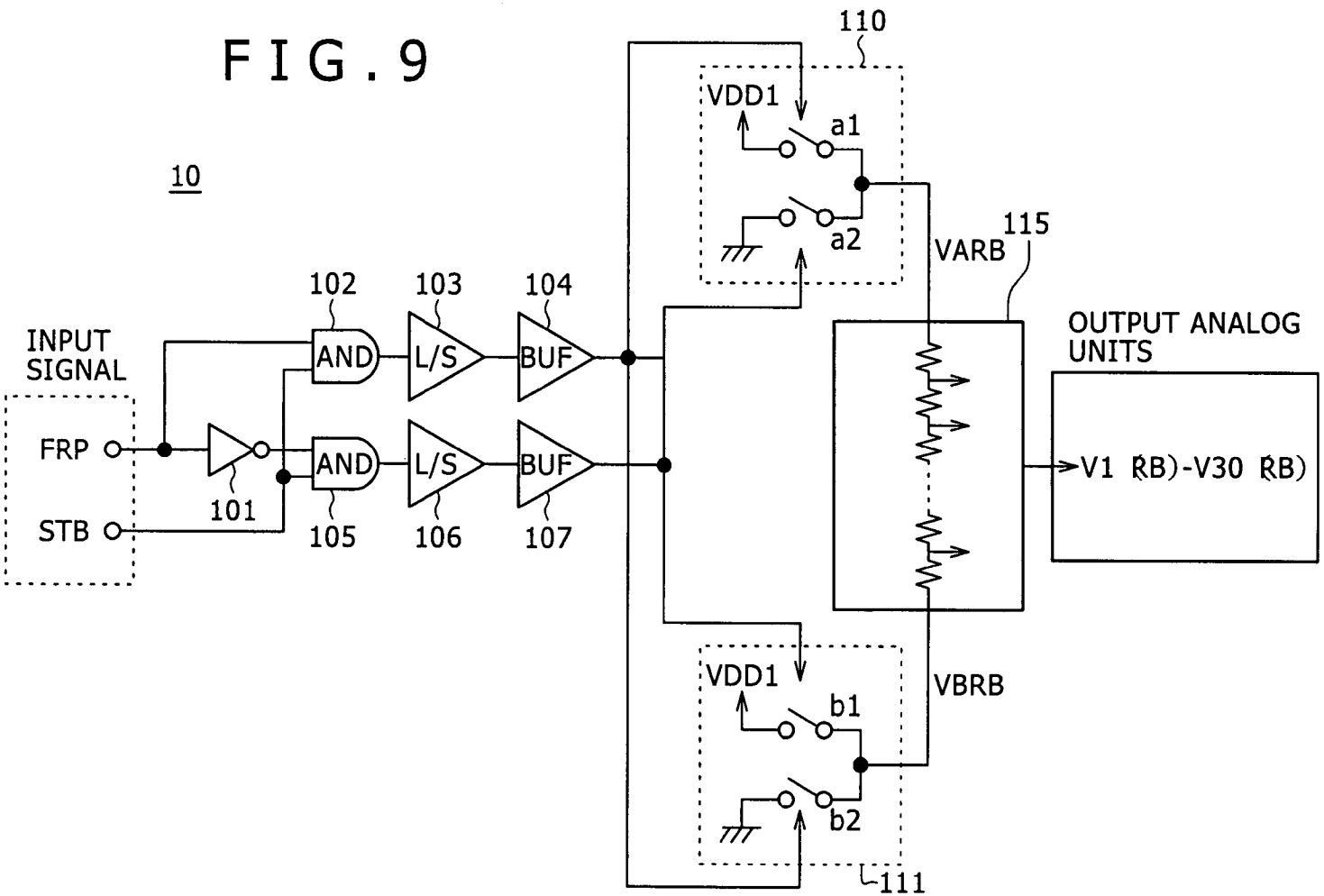
FIG. 9 is a circuit diagram showing an embodiment of an analog voltage generator included in a display apparatus.

FIG. 9 is a circuit diagram showing an embodiment of the analog voltage generator 10. As shown in the figure, the analog voltage generator 10 includes various gate elements 101 to 107, a pair of switching circuits 110, 111, and a ladder resistor 115. The ladder resistor 115 resistively splits the power supply voltage to generate a plurality of output analog potential levels V1 to V30. For example, when the display data is 5-bit data having 32 gradations, the analog voltage generator 10 outputs the analog potentials V1 to V30 corresponding to two levels at both ends plus 30 intermediate levels. As described above, the liquid crystal elements are driven by alternating current. Therefore, the polarity of the analog potentials output from the analog voltage generator 10 also has to be inverted at a specific interval. For this purpose, a pair of switching circuits 110 and 111 are connected to both ends of the ladder resistor 115. These switching circuits 110 and 111 are controlled by an input signal FRP via the gate elements 101 to 107. In the standby mode, an input signal STB is applied.

The power supply potential of the logic circuit section of the analog voltage generator 10 is fixed to VDD1 continuously. In the waiting mode, the input signals FRP and STB are fixed to the GND level. In the normal operation mode, FRP is inverted every frame between high and low levels. In the normal operation mode, as switches a1 and b2 or switches a2 and b1 in the switching circuits 110, 111 are turned on simultaneously in response to FRP, the ladder resistor 115 splits the potential VDD1 to generate the analog output voltages V1 to V30. In the waiting mode, the switches a1 and b1 (or the switches a2 and b2) in the switching circuits 110, 111 are turned on simultaneously. As a result, the potentials at both ends of the series ladder resistor 115 are equal to each other so as to prevent direct current from flowing and, therefore, reduce power consumption.

Figure 10:
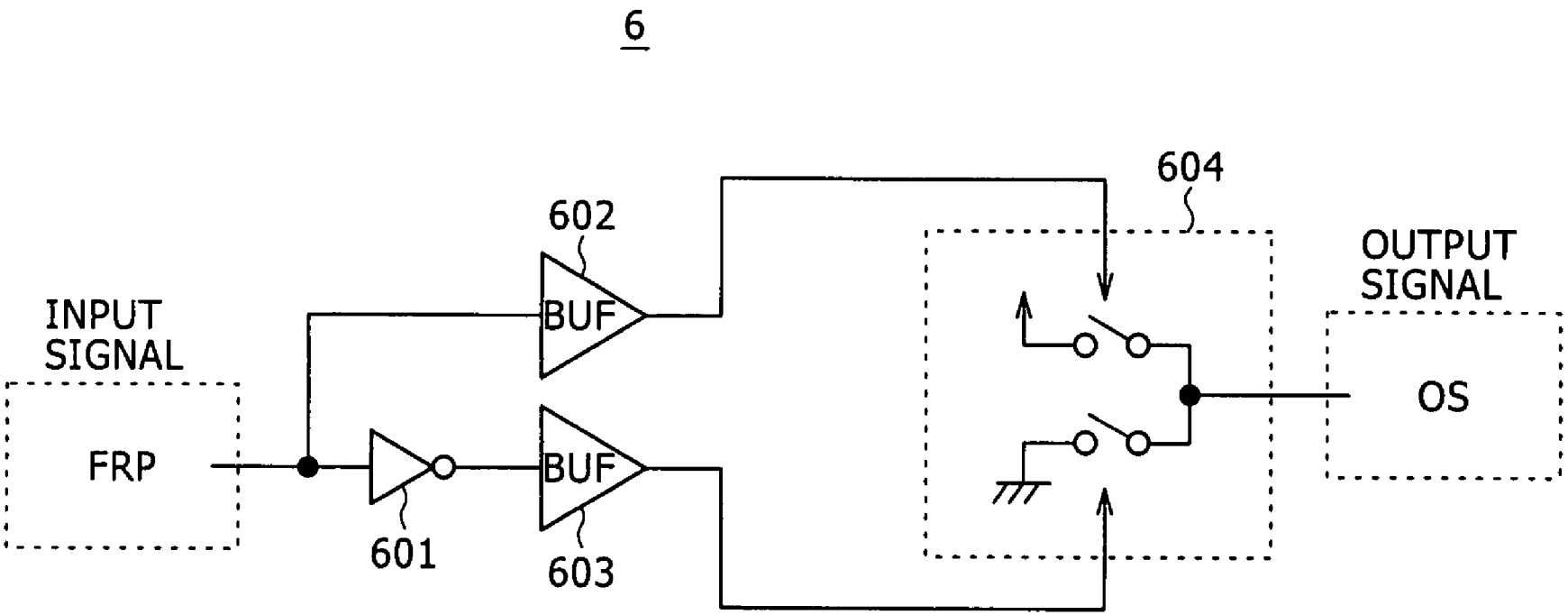
FIG. 10 is a circuit diagram showing an embodiment of a CS driver included in a display apparatus.

FIG. 10 is a circuit diagram showing an embodiment of a CS driver. The CS driver 6 includes an inverter 601, a buffer 602, a buffer 603, and a switching circuit 604 including a pair of switches. In the operation mode, in response to the input signal FRP, the pair of switches included in the switching circuit 604 are turned on alternately to supply the supplementary capacitance line CS with an output signal whose polarity is inverted every frame. In the waiting mode, the input signal FRP is fixed to a GND level. As a result, the potential of the output terminal of the CS driver 6 is fixed so as to prevent charge and discharge current from flowing into the supplementary capacitance line CS and, therefore, reduce power consumption.

Figure 11:
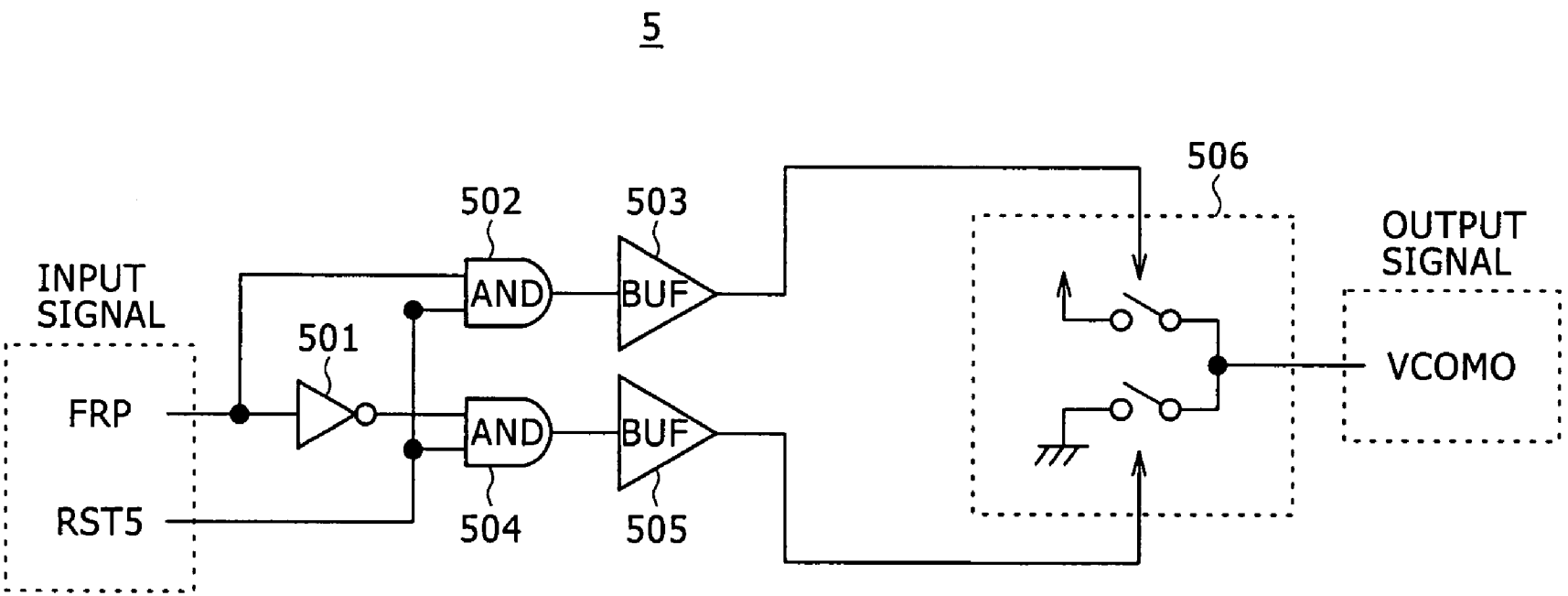
FIG. 11 is a circuit diagram showing an embodiment of a common driver included in a display apparatus.

FIG. 11 is a circuit diagram showing an embodiment of the COM driver 5. The COM driver 5 includes an inverter 501, an AND element 502, a buffer 503, an AND element 504, a buffer 505 and a switching circuit 506. Similarly to the CS driver 6 as described above, in the operation mode, in response to the input signal FRP, the COM driver 5 supplies the common electrode with an output signal VCOMO whose polarity is inverted every frame. In this connection, the COM driver 5 in this embodiment can be reset logically in response to an internal reset signal RST5.

In the waiting mode, as the DC/DC converter does not operate as described above, the power supply potential of the COM driver 5 is at the GND or VDD1 level. Further, as the timing generator does not operate, the input signal FRP is also fixed to the GND level or VDD1 level. As a result, the potential of the output signal VCOMO is fixed so as to prevent charge and discharge current from flowing into the common electrode and, therefore, reduce power consumption.

Figure 12:
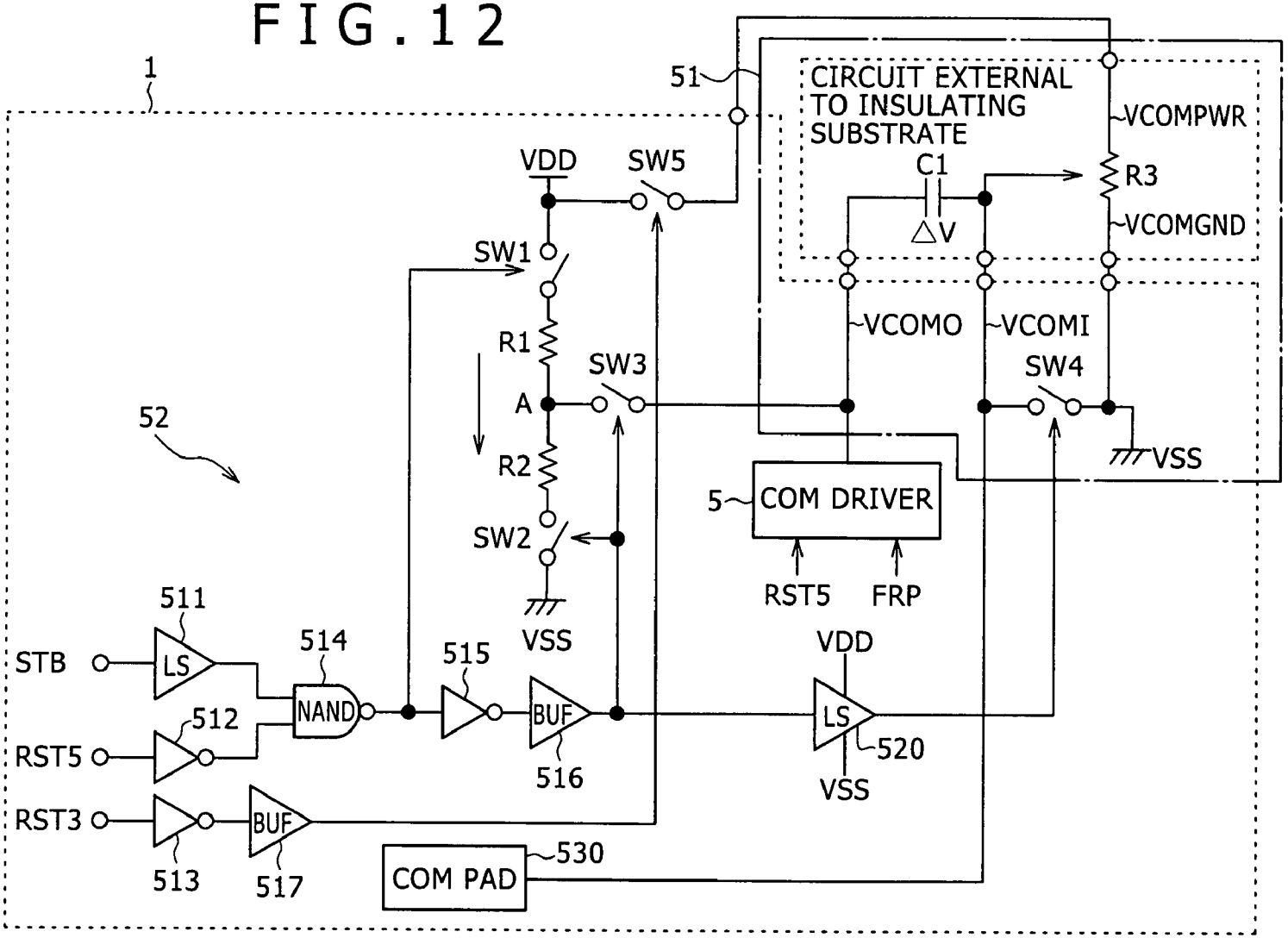
FIG. 12 is a circuit diagram showing an offset circuit for a common driver, and a start circuit included in a display apparatus.

Finally, FIG. 12 is a circuit diagram showing a specific exemplary configuration of the offset circuit 51 and the start circuit 52 associated with the COM driver 5. As described above, the common driver 5 applies the common voltage VCOM to the common electrode. The offset circuit 51 includes a coupling capacitor C1 that generates a specific offset voltage ΔV for adjusting the common voltage level relative to the signal voltage. As the power supply voltage VDD rises, the start circuit 52 precharges the coupling capacitor C1 of the offset circuit 51 up to the offset voltage ΔV, and, on the other hand, as the power supply voltage VDD falls, it discharges the coupling capacitor C1. As shown in the figure, the COM driver 5, the offset circuit 51 and the start circuit 52 are built on the common insulating substrate 1 except for the coupling capacitor C1 and a variable resistor R3.

The offset circuit 51 includes a transistor switch SW4 and the variable resistor R3 for voltage level adjustment in addition to the coupling capacitor C1 mentioned above. The resistor R3 is mounted externally similarly to the coupling capacitor C1. The transistor switch SW4 is formed on the insulating substrate 1. The common voltage VCOMI, which has already been offset, is input from the coupling capacitor C1 outside the insulating substrate 1 and connected via internal wiring to a COM pad 530, which is, in turn, connected to the common electrode inside the system display.

The start circuit 52 includes logic circuits, such as a level shifter 511 to which the standby signal STB is input, an inverter 512 to which the internal reset signal RST5 is input, an inverter 513 to which an external reset signal RST3 is input, a NAND element NAND 514, an inverter 515, a buffer (BUF) 516, a buffer 517 and a level shifter 520. Further, it includes switches SW1, SW2, SW3, SW5 comprised of thin-film transistors. In addition, it includes a pair of resistors R1, R2 connected in series between the positive power supply voltage VDD and the negative power supply voltage VSS. The connection point between the resistors R1 and R2 is designated as a node A.

Further referring to FIG. 12, the ON and OFF sequences of the start circuit 52 will be described. First, in the ON sequence in which the start circuit 52 returns from the waiting mode to the operation mode, the STB signal rises from low to high in the first step. This allows the switches SW1, SW2, SW3, SW4 to be conductive. The series resistors R1, R2 resistively split the power supply voltage VDD so that a desired intermediate potential is obtained at the node A. This intermediate potential is equal to the required offset potential ΔV. Because the SW3 and SW4 are made conductive, the potential of the node VCOMO is equal to that of the node A and, therefore, the coupling capacitor C1 is precharged. The ratio between the series resistors R1 and R2 is set so that the potential difference between the nodes A and VCOMO is ΔV. Then, in the second step, the reset signals RST3, RST5 rise to make the COM driver 5 active. At the same time, the switches SW1, SW2, SW3, SW4 are made inactive. On the other hand, the switch SW5 is made conductive, the node VCOMPWR is set to VDD, and a current flows through the variable resistor R3. Because the coupling capacitor C1 has been charged sufficiently in the initial first step, the output of the COM driver 5 is coupled and a potential shifted by ΔV is output to the node VCOMI. The variable resistor R3 is set so that the potential of VCOMI is just shifted by ΔV. Then, in the third step, a display start signal rises and an image appears on the display area.

Next, the OFF sequence in which the start circuit 52 is switched from the operation mode to the waiting mode will be described. First, the display instruction PCI from the main set falls and the image is deleted from the display area. Then, in the second step, the reset signals RST3, RST5 fall. This allows the switches SW1, SW2, SW3, SW4 to be conductive. In contrast, SW5 is made non-conductive. As a result, current does not flow through the external variable resistor R3 and desired power savings can be achieved. At the same time, because the COM driver 5 in the insulating substrate 1 is made inactive, power savings can be achieved. As the switches SW1, SW2 are made conductive, the series resistors R1, R2 allow the power supply potential VDD to be at the desired intermediate potential at the node A. At this time, as SW4 also is made conductive, the node VCOMI is at GND level. This allows the coupling capacitor C1 to be discharged. Finally, in the third step, the STB signal falls and the switches SW1, SW2, SW3, SW4 are made non-conductive. It isolates the series resistors R1, R2 from the positive power supply line VDD and the negative power supply line VSS so that unwanted current does not flow. Therefore, a desired power savings can be achieved.

As described above, according to the present invention, in the waiting mode, while power supply voltage is supplied from the main set, power consumption of the panel is suppressed by blocking the operation of the display and making the circuit section inside and outside the panel inactive. As a result, power consumption can be reduced significantly in comparison with the conventional partial mode feature. Further, it is possible to eliminate the need to provide the main set with a large capacity switch for shutting off the power supply, and, therefore, the main set can be downsized due to the reduced number of parts and cost can also be reduced. In particular, in the control sequence executed according to the present invention, the direct current components flowing through the resistive elements included in the circuit section are shut off during the inactivation. Further, in such a control sequence, the clocks supplied to the circuit section are blocked to suppress the charge and discharge occurring in the circuit section during the inactivation. Thus, the standby switching sequence is executed systematically so that a significant power savings can be expected in comparison with the related art.

The invention claimed is:

1. A display apparatus that is used as a display component of an electronic device capable of switching between a normal power consumption state and a low power consumption state and that comprises a panel in which a display area and a peripheral circuit section for driving the display area are integrally formed on an insulating substrate, wherein said circuit section can switch between an operation mode and a waiting mode in response to the switching between the normal power consumption state and the low power consumption state of a main body of the electronic device, said circuit section comprises standby control means that operates by receiving power supply voltage from the main body of the electronic device and drives the display area to show a desired image in the operation mode, and while receiving the power supply voltage from the main body of the electronic device, stops driving the display area and inactivates the circuit section to suppress power consumption of the panel in the waiting mode, and said standby control means executes a control sequence to shut off direct current components flowing through resistive elements at least included in the circuit section during the inactivation, and wherein said display area comprises pixel electrodes arranged as a matrix, common electrodes opposing to the pixel electrodes, and an electro-optic material held between the pixel and common electrodes, said circuit section comprises drivers for writing signal voltage to the pixel electrodes, a common driver for applying a common voltage to the common electrodes, and an offset circuit for adjusting a level of the common voltage relative to the signal voltage, and said standby control means executes a control sequence to shut off direct current components flowing through resistive elements included in the offset circuit during the inactivation.

2. The display apparatus according to claim 1, wherein said circuit section comprises a start circuit for charging the offset circuit so as to apply the common voltage quickly upon activation of the panel in addition to the common driver for applying the common voltage to the common electrodes and the offset circuit for adjusting the level of the common voltage, and said standby control means executes a control sequence to shut off direct current components flowing through resistive elements included in the start circuit during the inactivation.

3. The display apparatus according to claim 1, wherein said panel comprises thin-film transistors that form the display area and the peripheral circuit section for driving the display area on the common insulating substrate in an identical process.

4. A display apparatus that is used as a display component of an electronic device capable of switching between a normal power consumption state and a low power consumption state and that comprises a panel in which a display area and a peripheral circuit section for driving the display area are integrally formed on an insulating substrate, wherein said circuit section can switch between an operation mode and a waiting mode in response to the switching between the normal power consumption state and the low power consumption state of a main body of the electronic device, said circuit section comprises standby control means that operates by receiving power supply voltage from the main body of the electronic device and drives the display area to show a desired image in the operation mode, and while receiving the power supply voltage from the main body of the electronic device, stops driving the display area and inactivates the circuit section to suppress power consumption of the panel in the waiting mode, and said standby control means executes a control sequence to shut off direct current components flowing through resistive elements at least included in the circuit section during the inactivation, and wherein said display area comprises pixels arranged as a matrix, said circuit section comprises drivers for writing analog voltages having gradations in accordance with image information sent from the main body of the electronic device to the pixels, and an analog voltage generator for supplying at a plurality of levels of the analog voltages already corresponding to the gradations to the driver, and said standby control means executes a control sequence to shut off direct current components flowing through series resistive elements for voltage splitting included in the analog voltage generator during the inactivation.

5. A display apparatus that is used as a display component of an electronic device capable of switching between a normal power consumption state and a low power consumption state and that comprises a panel in which a display area and a peripheral circuit section for driving the display area are integrally formed on an insulating, wherein said circuit section can switch between an operation mode and a waiting mode in response to the switching between the normal power consumption state and the low power consumption state of a main body of the electronic device, said circuit section comprises standby control means that operates by receiving power supply voltage from the main body of the electronic device and drives the display area to show a desired image in the operation mode, and while receiving the power supply voltage from the main body of the electronic device, stops driving the display area and inactivates the circuit section to suppress power consumption of the panel in the waiting mode, and said standby control means executes a control sequence to shut off direct current components flowing through resistive elements at least included in the circuit section during the inactivation, and wherein said standby control means executes a control sequence to block clocks supplied to at least the circuit section to suppress charge and discharge occurring in the circuit section during the inactivation.

6. The display apparatus according to claim 5, wherein said circuit section comprises a DC/DC converter for converting a primary power supply voltage supplied from the main body of the electronic device to a secondary power supply voltage in accordance with specifications of the panel, and said standby control means executes a control sequence to block clocks supplied to the DC/DC converter to suppress charge and discharge occurring in the DC/DC converter during the inactivation.

* * * * *

UNITED STATES PATENT AND TRADEMARK OFFICE

CERTIFICATE OF CORRECTION

PATENT NO. : 7,379,058 B2
APPLICATION NO. : 10/542503
DATED : May 27, 2008
INVENTOR(S) : Noboru Toyozawa et al.

It is certified that error appears in the above-identified patent and that said Letters Patent is hereby corrected as shown below:

Front Page:
Item (54) and Column 1, line 1 should read:
-- DISPLAY APPARATUS --.

Column 13, Line 37:
"insulating, wherein" should read -- insulating substrate, wherein --.

Signed and Sealed this

Twenty-third Day of December, 2008

JON W. DUDAS
*Director of the United States Patent and Trademark Office*